US011169477B2

(12) United States Patent
Matsui

(10) Patent No.: US 11,169,477 B2
(45) Date of Patent: Nov. 9, 2021

(54) INFORMATION PROCESSING APPARATUS AND NON-TRANSITORY COMPUTER READABLE MEDIUM

(71) Applicant: FUJIFILM BUSINESS INNOVATION CORP., Tokyo (JP)

(72) Inventor: Takayuki Matsui, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 157 days.

(21) Appl. No.: 16/556,720

(22) Filed: Aug. 30, 2019

(65) Prior Publication Data

US 2020/0233358 A1 Jul. 23, 2020

(30) Foreign Application Priority Data

Jan. 23, 2019 (JP) ..... JP2019-009108

(51) Int. Cl.
*G03G 15/00* (2006.01)
*B41J 11/42* (2006.01)

(52) U.S. Cl.
CPC ..... *G03G 15/5075* (2013.01); *B41J 11/42* (2013.01); *G03G 15/6517* (2013.01)

(58) Field of Classification Search
CPC ..... G03G 15/5075; G03G 15/6517; G03G 15/652; G03G 15/6526; G03G 2215/00455; G03G 2215/00459; B41J 11/42; B65H 20/00
See application file for complete search history.

(56) References Cited

U.S. PATENT DOCUMENTS 4,377,333 A * 3/1983 Tsuji ..... G03G 15/6529 399/122
4,943,863 A * 7/1990 Ainoya ..... G03G 15/6526 399/297
2009/0207444 A1* 8/2009 Takagi ..... G03G 15/5012 358/1.15
2012/0070160 A1 3/2012 Aoki
2014/0151491 A1* 6/2014 Mizutani ..... B65H 26/063 242/563
2014/0292883 A1* 10/2014 Kato ..... B41J 11/42 347/16
2015/0177666 A1* 6/2015 Numazu ..... G03G 15/6517 399/397

FOREIGN PATENT DOCUMENTS

JP 2005-231062 A 9/2005
JP 2012-066895 A 4/2012
JP 2016-172339 A 9/2016

* cited by examiner

*Primary Examiner* — Sophia S Chen
(74) *Attorney, Agent, or Firm* — Oliff PLC

(57) ABSTRACT

An information processing apparatus includes a controller configured to, if it is determined that a connecting process of connecting a continuous sheet and another continuous sheet to each other is to be executed when a trailing end of the continuous sheet transported by a printing unit is detected, prohibit the continuous sheet from being transported in response to a user's operation at a time when the trailing end of the continuous sheet is detected.

16 Claims, 8 Drawing Sheets

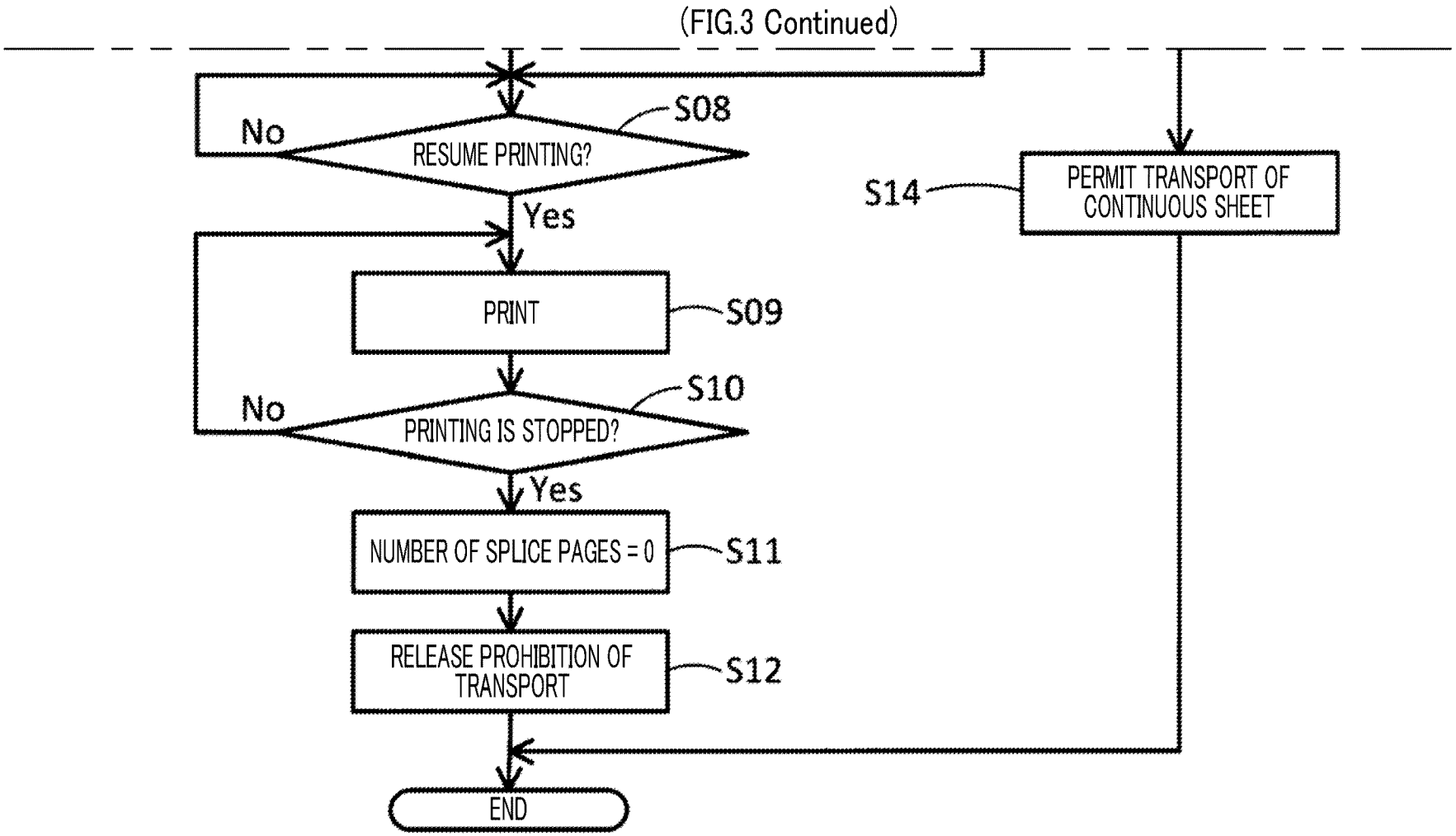
(FIG.3 Continued)
S08
RESUME PRINTING?
Yes
No
S09
PRINT
S10
PRINTING IS STOPPED?
Yes
No
S11
NUMBER OF SPLICE PAGES = 0
S12
RELEASE PROHIBITION OF TRANSPORT
S14
PERMIT TRANSPORT OF CONTINUOUS SHEET
END

INFORMATION PROCESSING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2019-009108 filed Jan. 23, 2019.

BACKGROUND

(i) Technical Field

The present disclosure relates to an information processing apparatus and a non-transitory computer readable medium.

(ii) Related Art

In a printing apparatus that performs printing on a continuous sheet, when a trailing end of the continuous sheet transported to the printing apparatus is detected, the continuous sheet and another continuous sheet may be connected to each other and printing may be continued.

JP-A-2012-066895 describes an apparatus which transports a band-shaped medium in which plural marks are arranged and formed, and determines a seam of the medium based on an interval of the marks detected in the medium.

JP-A-2016-172339 describes an apparatus in which a sensor detects a seam of a continuous form sheet.

JP-A-2005-231062 describes an apparatus which measures the amount of movement of a continuous sheet and calculates a position of a seam of the continuous sheet based on the distance from a reference position for connecting continuous sheets to a printing apparatus and the measured amount of movement so as to control printing on a periphery of the seam.

Meanwhile, when the continuous sheet and the other continuous sheet are connected to each other for printing and when it is always permitted to transport the continuous sheet in response to a user's operation, printing may be performed on a portion on which printing it not to be performed in the continuous sheet (for example, a seam portion between continuous sheets) depending on the user's operation.

SUMMARY

Aspects of non-limiting embodiments of the present disclosure relate to an information processing apparatus and a non-transitory computer readable medium capable of preventing printing from being performed on a portion, on which printing is not to be performed, of a continuous sheet when the continuous sheet and another continuous sheet are connected to each other for printing.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an information processing apparatus includes a controller configured to, if it is determined that a connection process of connecting a continuous sheet and another continuous sheet to each other is to be executed when a trailing end of the continuous sheet transported by a printing unit is detected, prohibit the continuous sheet from being transported in response to a user's operation at a time when the trailing end of the continuous sheet is detected.

BRIEF DESCRIPTION OF THE DRAWINGS

Exemplary embodiment(s) of the present disclosure will be described in detail based on the following figures, wherein.

DETAILED DESCRIPTION

Figure 1:
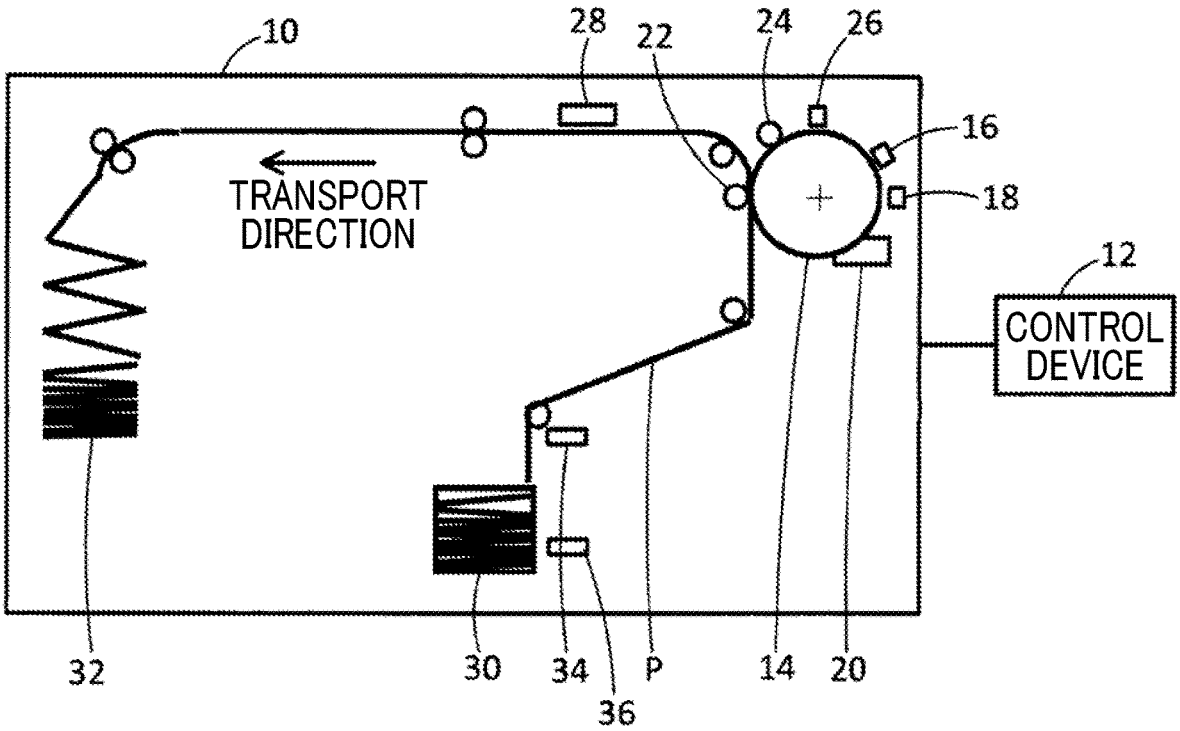
FIG. 1 is a diagram illustrating a configuration of a printing system according to an exemplary embodiment.

A printing system according to an exemplary embodiment of the present disclosure will be described with reference to FIG. 1. FIG. 1 is a diagram illustrating an example of a configuration of the printing system according to the present exemplary embodiment.

The printing system according to the present exemplary embodiment includes one or plural printing apparatuses 10 and a control device 12. The printing apparatus 10 and the control device 12 are connected to a communication path. The communication path may a wireless communication path or a wired communication path. The communication path is, for example, a network such as a local area network (LAN), the Internet, or the like. The printing apparatus 10 and the control device 12 may be directly connected to each other. Alternatively, the control device 12 may be incorporated in the printing apparatus 10.

The printing apparatus 10 is an apparatus that performs printing on a continuous sheet P which is a recording medium by an electrophotographic method, for example. The control device 12 is a device that controls start of printing, stop of the printing, start of transport of the continuous sheet P, and stop of the transport of the continuous sheet P by the printing apparatus 10, and the amount of movement of the continuous sheet P, and the like.

Specifically, in the printing apparatus 10, a charging device 16, an exposure device 18, a developing device 20, a transfer device 22, a cleaning device 24, and a charge removal device 26 are provided in order around a photoconductor drum 14. A fixing device 28 is provided downstream of the installation position of the transfer device 22 in a transport direction in which the continuous sheet P is transported. The photoconductor drum 14 is rotated, and the charging device 16 uniformly charges a surface of the photoconductor drum 14. The surface of the photoconductor drum 14 is exposed by the exposure device 18 based on print data, so that a latent image is formed on the surface of the photoconductor drum 14. Next, the latent image formed on the surface of the photoconductor drum 14 is developed by the developing device 20 so as to form a toner image, and the toner image is transferred onto the continuous sheet P by the transfer device 22. Next, fixing is performed on the continuous sheet P by the fixing device 28. Further, the cleaning device 24 removes the toner that remains on the surface of the photoconductor drum 14 without being transferred to the continuous sheet P by the transfer device 22. After charge removal by the charge removal device 26 is performed, the charging by the charging device 16 and the subsequent processes are repeated. An inkjet method may be used as a printing method.

The printing apparatus 10 also includes a sheet hopper 30 and a sheet stacker 32. The sheet hopper 30 is a sheet feeding unit that supplies the continuous sheet P. The sheet stacker 32 is an accommodating unit that accommodates the continuous sheet P on which printing is completed. The sheet hopper 30 is provided upstream of the installation position of the transfer device 22 in the transport direction. The sheet stacker 32 is provided downstream of an installation position of the fixing device 28 in the transport direction. The sheet hopper 30 accommodates the continuous sheet P in a state of being folded. The continuous sheet P is supplied from the sheet hopper 30 to a transfer position between the photoconductor drum 14 and the transfer device 22. For example, folds such as perforations extending in a direction orthogonal to the transport direction are formed on the continuous sheet P at regular intervals, and the continuous sheet P is folded with these folds and accommodated in a box or the like. The continuous sheet P is transported from the sheet hopper 30 to the transfer position between the photoconductor drum 14 and the transfer device 22, for example, by a roller or the like that are rotated by a transport driving motor, and then passes through the fixing device 28 and is transported to the sheet stacker 32, and is accommodated in the sheet stacker 32 in a folded state. In the sheet stacker 32, the continuous sheet P on which printing is completed is folded with folds and stored in a box or the like. Hereinafter, the folded continuous sheet P is also referred to as "box sheet". The continuous sheet P may be folded and put in a box, and the whole box may be placed in the sheet hopper 30, or the continuous sheet P may be taken out from the box and placed in the sheet hopper 30.

The continuous sheet P other than the box sheet, such as a continuous sheet wound in a roll shape (hereinafter, referred to as "roll sheet"), may be used.

A detection sensor 34 that detects the trailing end of the continuous sheet P is provided at a position along a transporting path of the continuous sheet P between the transfer device 22 and the sheet hopper 30. By the detection sensor 34 detecting the trailing end of the continuous sheet P, it is detected that there is no continuous sheet P accommodated in the sheet hopper 30.

Further, a detection sensor 36 that detects the continuous sheet P in the sheet hopper 30 may be provided. The detection sensor 36 detects if there is no continuous sheet P accommodated in the sheet hopper 30.

Figure 2:
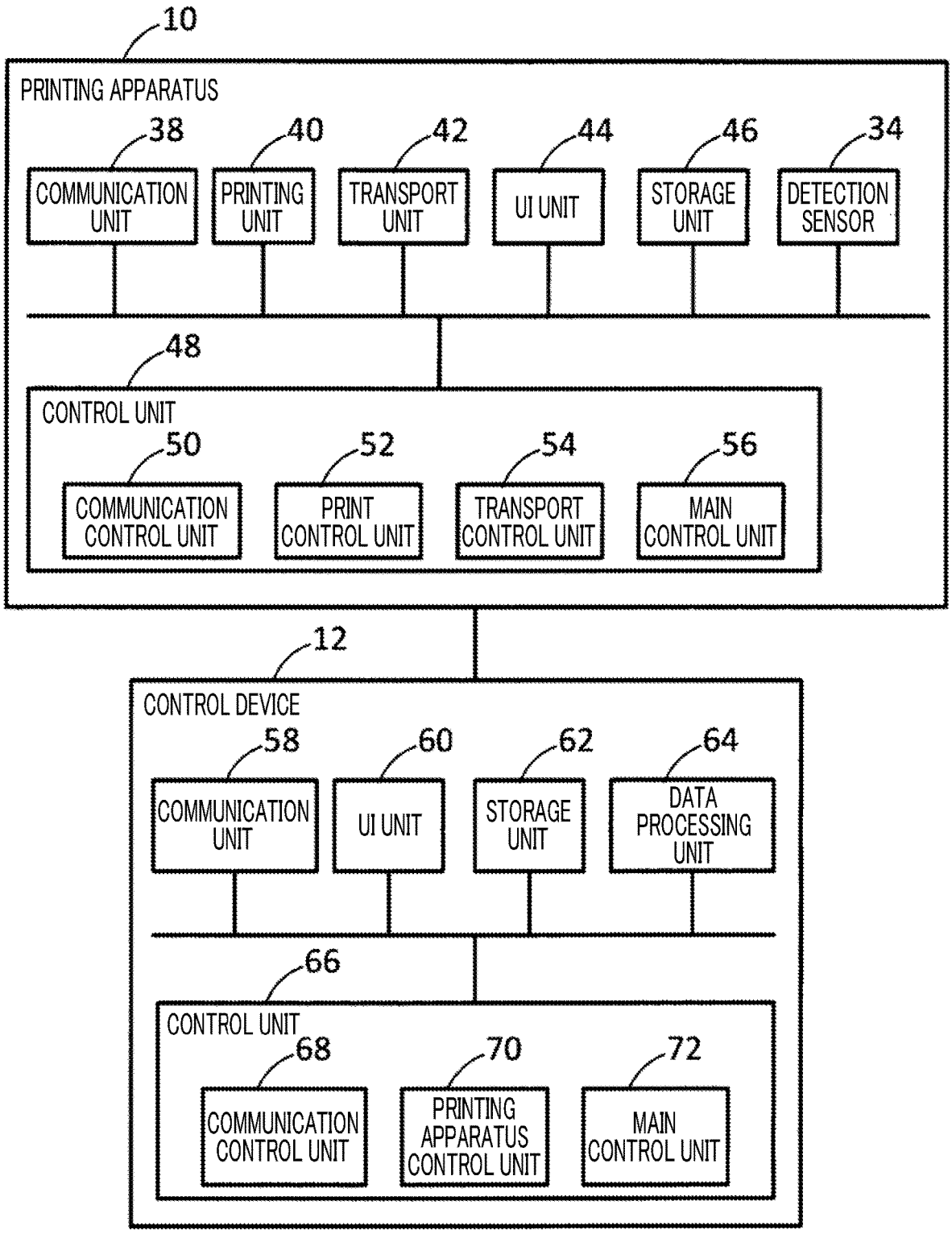
FIG. 2 is a block diagram illustrating the configuration of the printing system according to the exemplary embodiment.

Hereinafter, functions of the printing system according to the present exemplary embodiment will be described with reference to FIG. 2. FIG. 2 is a diagram illustrating an example of a configuration of the printing system according to the present exemplary embodiment.

The printing apparatus 10 includes a communication unit 38, a printing unit 40, a transport unit 42, a UI unit 44, a storage unit 46, and a control unit 48.

The communication unit 38 is a communication interface, and has a function of transmitting information to another device and a function of receiving information from another device. The communication unit 38 may have a wireless communication function or a wired communication function. The communication unit 38 receives, for example, print job information including print data and print instruction information, control information on transport of the continuous sheet P, other control information, and the like from the control device 12.

The printing unit 40 is configured to perform printing on the continuous sheet P. The printing unit 40 includes, for example, the photoconductor drum 14, the charging device 16, the exposure device 18, the developing device 20, the transfer device 22, the cleaning device 24, the charge removal device 26, and the fixing device 28.

The transport unit 42 includes, for example, the transport driving motor and the roller. The transport unit 42 is configured to transport the continuous sheet P. The transport unit 42 transports the continuous sheet P from the sheet hopper 30 to the printing unit 40, and then transports the continuous sheet P to the sheet stacker 32.

The UI unit 44 is a user interface unit. The UI unit 44 includes a display unit and an operation unit. The display unit is a display device such as a liquid crystal display or the like. The operation unit is an input device such as a keyboard, an input key, an operation panel, or the like. The UI unit 44 may be a UI unit such as a touch panel having the display unit and the operation unit or the like.

The storage unit 46 is one or plural storage regions which store various types of information. Each storage region is implemented by, for example, one or plural storage devices (for example, a physical drive such as a hard disk drive, a memory, or the like) provided in the printing apparatus 10. The storage unit 46 stores the print job information and the like.

The detection sensor 34 is a sensor that detects the trailing end of the continuous sheet P.

The control unit 48 includes a communication control unit 50, a print control unit 52, a transport control unit 54, and a main control unit 56.

The communication control unit 50 is configured to control communication by the communication unit 38.

The print control unit 52 is configured to control printing by the printing unit 40 according to a print job.

The transport control unit 54 is configured to control transport of the continuous sheet P by the transport unit 42. The transport control unit 54 controls the transport of the continuous sheet P, for example, by controlling drive of the transport driving motor in the transport unit 42. For example, when it is permitted to transport the continuous sheet P in response to a user's operation and when the user gives an instruction to transport the continuous sheet P using the UI unit 44 of the printing apparatus 10 or a UI unit 60 of the control device 12, the transport control unit 54 causes the transport unit 42 to transport the continuous sheet P in accordance with the user's instruction. When a paper jam or the like occurs, the user may want to transport the continuous sheet P by his/her operation. Therefore, the printing apparatus 10 is configured to transport the continuous sheet P in response to the user's operation. In addition, the transport control unit 54 is configured to measure the amount of movement of the continuous sheet P. For example, the transport control unit 54 may measure the amount of movement of the continuous sheet P based on the rotation amount of the transport driving motor or the like. Alternatively, the transport control unit 54 may measure the amount of movement of the continuous sheet P based on the number of pulses applied to the transport driving motor or the like.

The main control unit 56 is configured to control an operation of each unit of the printing apparatus 10.

The control device 12 includes a communication unit 58, the UI unit 60, a storage unit 62, a data processing unit 64, and a control unit 66.

The communication unit 58 is a communication interface. The communication unit 58 has a function of transmitting information to another device and a function of receiving information from another device. The communication unit 58 may have a wireless communication function or a wired communication function. The communication unit 58 transmits, for example, the print job information, the control information on the transport of the continuous sheet P, other control information, and the like to the printing apparatus 10.

The UI unit 60 is a user interface unit. The UI unit 60 includes a display unit and an operation unit. The display unit is a display device such as a liquid crystal display or the like. The operation unit is an input device such as a keyboard, an input key, or the like. The UI unit 60 may be a UI unit such as a touch panel having the display unit and the operation unit or the like.

The storage unit 62 is one or plural storage regions which store various types of information. Each storage region is implemented by, for example, one or plural storage devices (for example, a physical drive such as a hard disk drive, a memory, or the like) provided in the control device 12.

The data processing unit 64 is configured to generate and analyze print data that is printable by the printing apparatus 10. The print data is, for example, bitmap data, page description language (PDL) data, or the like.

The control unit 66 includes a communication control unit 68, a printing apparatus control unit 70, and a main control unit 72.

The communication control unit 68 is configured to control communication by the communication unit 58.

The printing apparatus control unit 70 is configured to control an operation of the printing apparatus 10. The printing apparatus control unit 70 transmits, for example, the print job information to the print control unit 52 of the printing apparatus 10, and transmits the control information on the transport of the continuous sheet P to the transport control unit 54.

The main control unit 72 is configured to control an operation of each unit of the control device 12.

In the present exemplary embodiment, when the trailing end of the continuous sheet P is detected by the detection sensor 34, connecting process (hereinafter, which may be referred to as a "splicing process") of connecting the trailing end of the continuous sheet P and the leading end of another new continuous sheet P may be executed. For example, the trailing end of the continuous sheet P and the leading end of the other new continuous sheet P are bonded to each other by a splicing tape, so that the continuous sheets P are connected to each other. Then, printing is performed on the connected continuous sheet P. By executing the splicing process, it is possible to save time and effort for inserting the new continuous sheet P into the printing apparatus 10, and waste paper is reduced as compared with a case of inserting the new continuous sheet P into the printing apparatus 10.

If determining that the splicing process is to be executed when the trailing end of the continuous sheet P is detected by the detection sensor 34, the transport control unit 54 prohibits the continuous sheet P from being transported in response to a user's operation at a time when the trailing end of the continuous sheet P is detected by the detection sensor 34. For example, even when the user gives an instruction to transport the continuous sheet P using the UI unit 44 of the printing apparatus 10 or the UI unit 60 of the control device 12, the transport control unit 54 does not allow the transport unit 42 to transport the continuous sheet P. A period during which the transport of the continuous sheet P is prohibited (hereinafter, referred to as "transport prohibition period") is, for example, a period from a timing when the trailing end of the continuous sheet P is detected (hereinafter, referred to as "trailing end detection timing") to a predetermined timing. For example, when the trailing end of the continuous sheet P is detected by the detection sensor 34, printing is stopped and then the printing may be resumed after the continuous sheets P are connected. In this case, the transport prohibition period of the continuous sheet P is a period from the trailing end detection timing to a timing when the resumed printing is stopped (hereinafter, referred to as "printing stop timing"). A period from the trailing end detection timing to a timing between the trailing end detection timing and the printing stop timing may be determined as the transport prohibition period of the continuous sheet P. For example, when it is released at a timing after the trailing end detection timing that the continuous sheet P is prohibited from being transported in response to a user's operation, a timing when the release is performed may be determined as an end timing of the transport prohibition period. Further, a timing after a predetermined time elapses from the trailing end detection timing may be determined as a start timing of the transport prohibition period of the continuous sheet P (a period during which the continuous sheet P is prohibited from being transported in response to the user's operation). That is, the trailing end detection timing may not be strictly determined as the start timing of the transport prohibition period, but a timing slightly after the trailing end detection time may be determined as the start timing of the transport prohibition period. Meanwhile, the transport prohibition period includes a period during which the transport of the continuous sheet P is not prohibited (that is, a period during which the transport prohibition is released) if it is determined that the splicing process is not to be executed.

In the present exemplary embodiment, the user may give an instruction to execute the splicing process. Alternatively, the control device 12 may determine whether to execute the splicing process without the user making a setting and control the execution of the splicing process. Further alternatively, the control device 12 may make the determination in accordance with a user's instruction indicating that the control device 12 determines whether to execute the splicing process. The phrase "the user gives the instruction to execute the splicing process" may refer to (i) that the user gives an instruction to execute the splicing process in advance before the trailing end of the continuous sheet P is detected or (ii) that the user gives an instruction to execute the splicing process after the trailing end of the continuous sheet P is detected. The scope of the concept that the control device 12 controls the execution of the splicing process without the user making a setting includes that even if a user gives no instruction about the splicing process, the control device 12 automatically determines whether to execute the splicing process and controls the execution of the splicing process.

Figure 3:
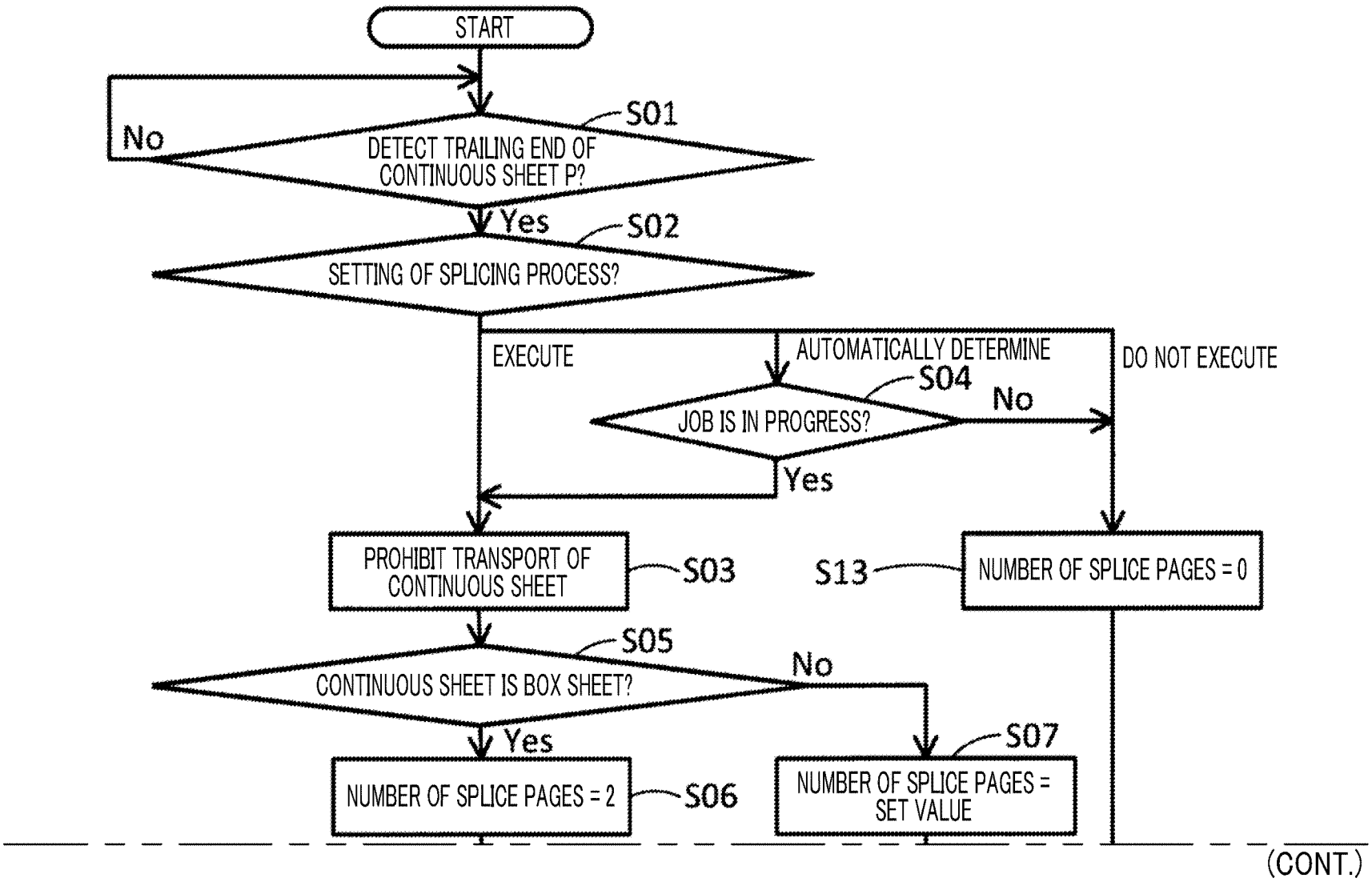
FIG. 3 is a diagram illustrating a flowchart related to transport control of a continuous sheet according to the exemplary embodiment.

Hereinafter, transport control of the continuous sheet P at the time when the trailing end of the continuous sheet P is detected will be described with reference to FIG. 3. FIG. 3 is a diagram illustrating a flowchart related to the transport control.

The printing unit 40 performs printing on the continuous sheet P in accordance with the print job. The transport control unit 54 prohibits the continuous sheet P from being transported in response to the user's operation during the printing. When the trailing end of the continuous sheet P is not detected by the detection sensor 34 (No in S01), the printing according to the print job is performed.

When the trailing end of the continuous sheet P is detected by the detection sensor 34 (Yes in S01), a process according to a setting of the splicing process is executed. Contents of the setting indicate (i) "execute the splicing process", (ii) "automatically determine whether to execute the splicing process", or (iii) "do not execute the splicing process". For example, a user sets any one of the above options using the UI unit 44 or the UI unit 60. Information indicating the selected option is stored, for example, in the storage unit 46. When neither the option indicating "execute the splicing process" nor the option indicating "automatically determine whether to execute the splicing process" is set, the option indicating "do not execute the splicing process" may be automatically set. The above setting is made before the trailing end of the continuous sheet P is detected by the detection sensor 34. For example, the above setting is made before the printing starts.

When the instruction to execute the splicing process is given by the user in advance before the trailing end of the continuous sheet P is detected by the detection sensor 34 ("execute" in S02), that is, when the option indicating "execute the splicing process" is set by the user in advance, the transport control unit 54 prohibits the continuous sheet P from being transported in response to the user's operation (S03). In this case, even when the print job is completed, the transport control unit 54 prohibits the continuous sheet P from being transported in response to the user's operation. For example, a physical sheet transport key for allowing the user to give an instruction to transport the continuous sheet P is provided in the UI unit 44 or the UI unit 60. Alternatively, an image of the sheet transport key is displayed on the UI unit 44 or the UI unit 60. Even when the user operates the sheet transport key, the transport control unit 54 disables the operation of the sheet transport key or does not accept the operation.

When the instruction to determine whether to execute the splicing process is given by the user in advance before the trailing end of the continuous sheet P is detected by the detection sensor 34 ("automatically determine" in S02), that is, when the option indicating "automatically determine whether to execute the splicing process" is set by the user in advance, the process proceeds to S04. If the print job is in progress at the time when the trailing end of the continuous sheet P is detected (Yes in S04), that is, if printing remains, the transport control unit 54 prohibits the continuous sheet P from being transported in response to the user's operation (S03). If the print job is in progress, it is expected that the splicing process is executed and the printing is continued. Therefore, the transport control unit 54 prohibits the continuous sheet P from being transported in response to the user's operation. If the print job is completed (No in S04), the process proceeds to S13.

When the execution of the splicing process is not set by the user in advance before the trailing end of the continuous sheet P is detected by the detection sensor 34 ("do not execute" in S02), that is, when the option indicating "do not execute the splicing process" is set by the user in advance, the process proceeds to S13. Processes at S13 and subsequent steps will be described later.

Hereinafter, processes at S05 and subsequent steps will be described.

When the splicing process is to be executed, the user places a new continuous sheet P in the sheet hopper 30 and bonds the trailing end of the continuous sheet P of which the trailing end is detected to the leading end of the new continuous sheet P by a splicing tape, thereby connecting the continuous sheets P to each other. For example, when the user inputs information indicating completion of connecting the continuous sheets P using the UI unit 44 or the UI unit 60, the transport control unit 54 recognizes the completion of connecting the continuous sheets P. A button for notifying the completion may be displayed on the UI unit 44 or the UI unit 60. When the user presses the button, the transport control unit 54 may recognize the completion.

Hereinafter, in the continuous sheet P, a page bonded to another page by a splicing tape will be referred to as a "splice page". When a box sheet is used as the continuous sheet P, the last page of the continuous sheet P of which the trailing end is detected and a top page of a new continuous sheet P are bonded to each other by a splicing tape. Therefore, the last page and the top page are splice pages.

In order to prevent printing according to the print job on the splice page, blank paper printing is performed on the splice page after the continuous sheets P are connected to each other. The blank paper printing refers to (i) that the printing unit 40 actually performs printing with a white color or (ii) that the printing unit 40 does not perform any printing.

The number of splice pages is determined according to a type of the continuous sheet P. When the continuous sheet P used in the printing apparatus 10 is a box sheet (Yes in S05), the number of splice pages is two (S06).

When the continuous sheet P used in the printing apparatus 10 is not a box sheet (No in S05), the number of splice pages is the number of pages set by the user (S07). For example, when the continuous sheet P is a roll sheet, the number of pages set by the user is set as the number of splice pages. The number of splice pages is designated by the user using the UI unit 44 or the UI unit 60, for example.

For example, the type of the continuous sheet P is designated by the user using the UI unit 44 or the UI unit 60, and information indicating the type is stored in the storage unit 46. As another example, a recognition sensor that recognizes the type of the continuous sheet P may be provided in the printing apparatus 10. For example, the recognition sensor that recognizes a box sheet may be provided, and the number of splice pages may be set according to a recognition result by the recognition sensor. The splice page and the blank paper printing will be described in detail later.

When connection of the continuous sheets P is completed, for example, when the user gives an instruction to resume printing using the UI unit 44 or the UI unit 60 (Yes in S08), the connected continuous sheet P is transported by the transport unit 42, and then printing is performed on the continuous sheet P by the printing unit 40 (S09). When the instruction to resume printing is not given (No in S08), the printing apparatus 10 waits until the instruction to resume printing is given.

When the continuous sheet P is a box sheet, the blank paper printing is performed on two pages of the splice pages, and printing according to the print job is performed on the other pages. Specifically, the blank paper printing is performed on the last page having the trailing end in the continuous sheet P of which the trailing end is detected and a top page having the leading end of the new continuous sheet P. The printing according to the print job is performed on the second and subsequent pages of the new continuous sheet P.

When the continuous sheet P is not a box sheet, the blank paper printing is performed on splice pages the number of which is set by the user, and the printing according to the print job is performed on the other pages.

When the print job given to the printing apparatus 10 is completed and printing is not stopped (No in S10), the printing is continuously performed (S09). The transport control unit 54 prohibits the continuous sheet P from being transported in response to the user's operation during the printing.

When the print job given to the printing apparatus 10 is completed and the printing is stopped (Yes in S10), the transport control unit 54 sets the number of splice pages to 0 page (zero page) (S11), and releases the prohibition of the transport of the continuous sheet P in response to the user's operation (S12). That is, the transport control unit 54 permits to transport the continuous sheet P in response to the user's operation. For example, the transport control unit 54 enables an operation of the sheet transport key and accepts the operation. The user operates the sheet transport key to thereby transport the continuous sheet P. For example, automatic discharge, forward movement, backward movement, or the like of the continuous sheet P are performed.

As described above, the transport control unit 54 prohibits the continuous sheet P from being transported in response to the user's operation from the trailing end detection timing when the trailing end of the continuous sheet P is detected by the detection sensor 34 to the printing stop timing when printing is resumed and the printing is stopped.

When it is prohibited that the continuous sheet P is transported in response to the user's operation and when the user gives an instruction to release the transport prohibition, the transport control unit 54 may release the transport prohibition. For example, a physical release button for releasing the transport prohibition is provided in the UI unit 44 or the UI unit 60. Alternatively, an image representing the release button is displayed on the UI unit 44 or the UI unit 60. When the user presses the release button, the transport control unit 54 releases the transport prohibition. When the transport prohibition is released, it is permitted to transport the continuous sheet P in response to the user's operation.

Hereinafter, the processes at S13 and subsequent steps will be described.

When the trailing end of the continuous sheet P is detected, the transport control unit 54 sets the number of splice pages to 0 (S13), and permits to transport the continuous sheet P in response to the user's operation (S14). That is, it is prohibited during the printing that the continuous sheet P is transported in response to the user's operation, but the transport control unit 54 releases the prohibition. For example, the transport control unit 54 enables an operation of the sheet transport key and accepts the operation.

As described above, (i) when the option indicating "execute the splicing process" is set by the user or when the option indicating "automatically determine whether to execute the splicing process" is set by the user and (ii) when the print job is in progress at the time when the trailing end of the continuous sheet P is detected, it is prohibited that the continuous sheet P is transported in response to the user's operation at the time when the trailing end of the continuous sheet P is detected.

On the other hand, when the option indicating "do not execute the splicing process" is set by the user, it is permitted to transport the continuous sheet P in response to the user's operation at the time when the trailing end of the continuous sheet P is detected.

In other words for the transport control according to the present exemplary embodiment, the transport control unit 54 prohibits the continuous sheet P from being transported in response to the user's operation during a period in which the printing unit 40 performs printing on the continuous sheet P, releases the prohibition when the trailing end of the continuous sheet P is detected by the detection sensor 34, and permits to transport the continuous sheet P in response to the user's operation. Then, (i) when the option indicating "execute the splicing process" is set or when the option indicating "automatically determine whether to execute the splicing process" is set and (ii) when the print job is in progress at the time when the trailing end of the continuous sheet P is detected, the transport control unit 54 continues the prohibition without releasing the prohibition of the transport of the continuous sheet P in response to the user's operation.

In the above example, (i) whether to execute the splicing process or (ii) the option indicating "automatic determine" is set by the user in advance before the trailing end of the continuous sheet P is detected. The setting may be made when the trailing end of the continuous sheet P is detected. For example, when the trailing end of the continuous sheet P is detected, the control unit 48 executes a process of inquiring the user whether to execute the splicing process. When the instruction to execute the splicing process is given by the user, the control unit 48 prohibits the continuous sheet P from being transported in response to the user's operation. Specifically, the main control unit 56 causes the UI unit 44 or the UI unit 60 to display a screen for the inquiry. The inquiry screen is a screen for allowing the user to set the option indicating "execute the splicing process", the option indicating "automatically determine whether to execute the splicing process", or the option "do not execute the splicing process". Information indicating these options is displayed on the inquiry screen. The transport control unit 54 controls the transport of the continuous sheet P in accordance with the settings made on the inquiry screen. In the same manner as the process described above, when the option indicating "execute the splicing process" is set, the process at S03 and subsequent steps are performed. When the option indicating "automatically determine whether to execute the splicing process" is set, the process at S04 and subsequent steps is performed. When the option indicating "do not execute the splicing process" is set, the process at S13 and subsequent steps is performed.

In addition, the transport control unit 54 may prohibit the continuous sheet P from being transported until the user gives an instruction about the splicing process on the inquiry screen. That is, the transport control unit 54 prohibits the continuous sheet P from being transported from the timing when the trailing end of the continuous sheet P is detected until the user gives an instruction. In addition, when the user sets the option indicating "do not execute the splicing process", the transport control unit 54 releases the prohibition of the transport of the continuous sheet P in response to the user's operation.

Figure 4:
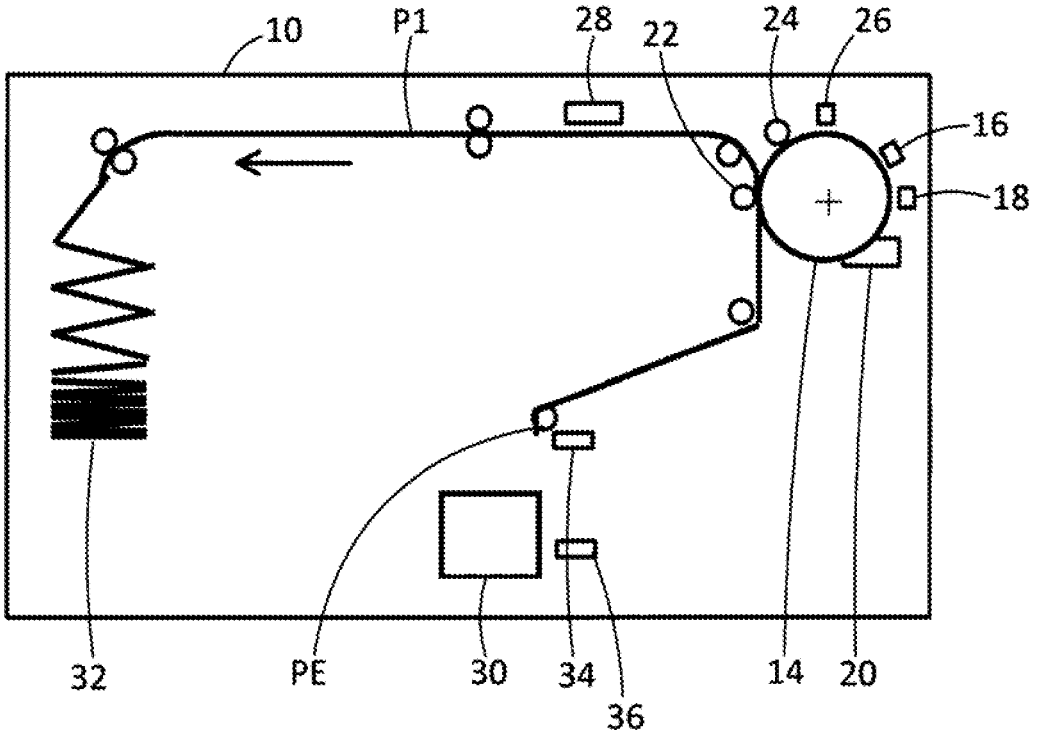
FIG. 4 is a diagram illustrating a configuration of a printing apparatus according to the exemplary embodiment.
Figure 5:
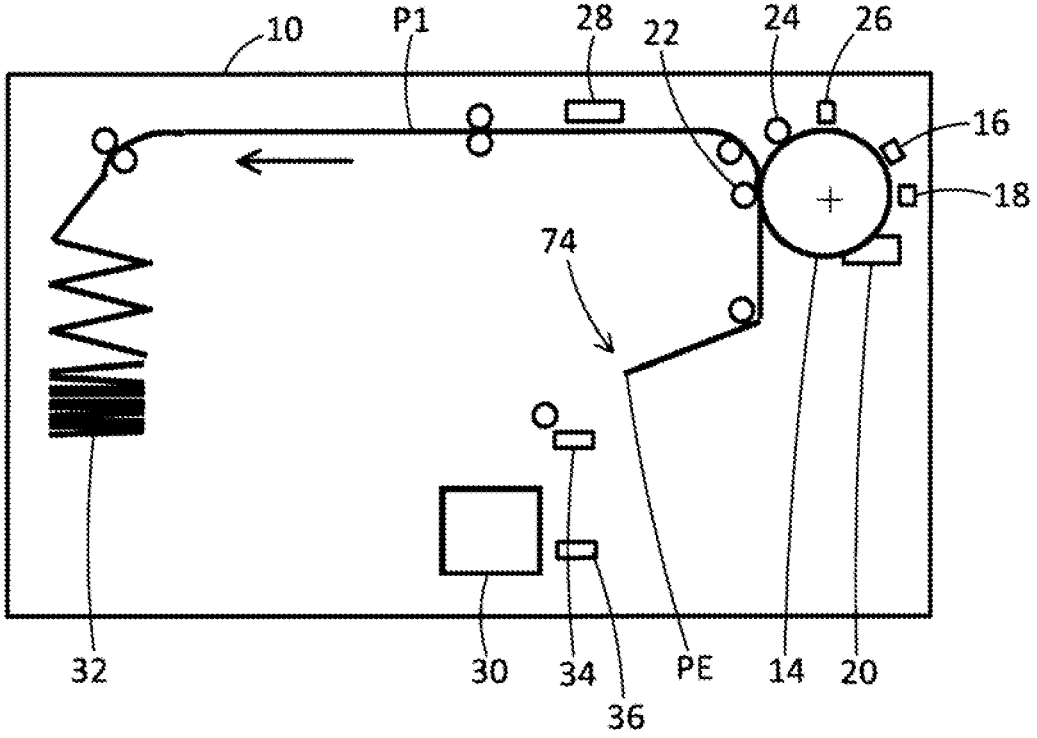
FIG. 5 is a diagram illustrating the configuration of the printing apparatus according to the exemplary embodiment.
Figure 6:
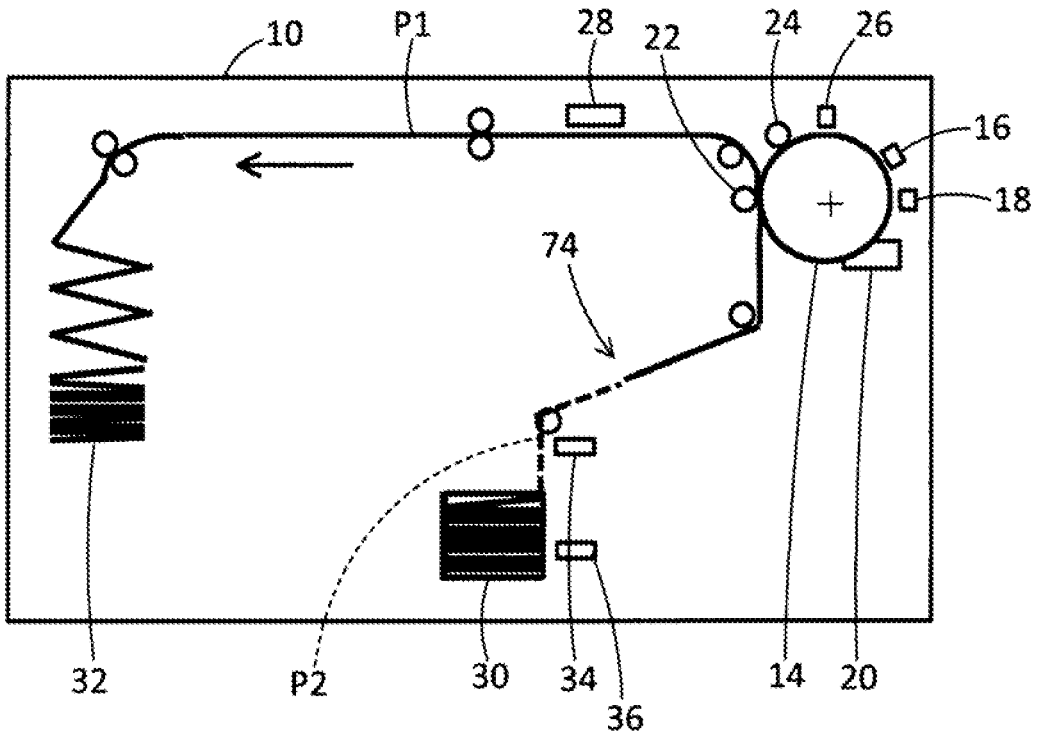
FIG. 6 is a diagram illustrating the configuration of the printing apparatus according to the exemplary embodiment.

Hereinafter, the transport control of the continuous sheet P will be described in more detail with reference to FIGS. 4 to 6. FIGS. 4 to 6 illustrate examples of a configuration of the printing apparatus. Here, it is assumed that a box sheet is used. Further, for the convenience of description, the continuous sheet P of which the trailing end is detected will be referred to as a "continuous sheet P1", and another new continuous sheet P will be referred to as a "continuous sheet P2".

FIG. 4 illustrates that a trailing end PE of the continuous sheet P1 is detected by the detection sensor 34. By detecting the trailing end PE, the transport control unit 54 recognizes that the sheet hopper 30 has no continuous sheet P1. The transport control unit 54 may recognize the presence or absence of the continuous sheet P1 in the sheet hopper 30 based on a detection result of the detection sensor 36 which detects the continuous sheet P1 in the sheet hopper 30. When the option indicating "do not execute the splicing process" is set by the user and when the trailing end PE is detected by the detection sensor 34, the printing unit 40 stops printing after transfer to a page being transferred to is completed. In this case, the transport control unit 54 permits to transport the continuous sheet P in response to the user's operation. In the same manner, when the option indicating "automatically determine whether to execute the splicing process" is set and when the print job has been completed at a timing when the trailing end PE is detected, the printing unit 40 stops printing after transfer to the page being transferred to is completed. Also in this case, the transport control unit 54 permits to transport the continuous sheet P in response to the user's operation.

When the option indicating "execute the splicing process" is set by the user and when the trailing end PE is detected by the detection sensor 34, as illustrated in FIG. 5, the transport control unit 54 causes the transport unit 42 to transport the continuous sheet P1 until the trailing end PE is placed at a splice position 74. In addition, the transport control unit 54 prohibits the continuous sheet P from being transported in response to the user's operation. In the same manner, when the option indicating "automatically determine whether to execute the splicing process" is set and when the print job is in progress at the timing when the trailing end PE is detected, the transport control unit 54 causes the transport unit 42 to transport the continuous sheet P1 until the trailing end PE is placed at the splice position 74. Also in this case, the transport control unit 54 prohibits the continuous sheet P from being transported in response to the user's operation. The splice position 74 is a position at which the user performs work of connecting the continuous sheets P to each other. For example, the splice position 74 is located downstream of the installation position of the detection sensor 34 in the transport direction and upstream of the installation position of the transfer device 22 in the transport direction. The splice position 74 may be the installation position of the detection sensor 34. In this case, after the trailing end PE is detected, the transport control unit 54 does not transport the continuous sheet P1.

Next, as illustrated in FIG. 6, another continuous sheet P2 which is a box sheet is placed in the sheet hopper 30 by the user. In order to distinguish and illustrate the continuous sheet P1 and the continuous sheet P2, the continuous sheet P2 is represented by a broken line. At the splice position 74, the trailing end PE of the continuous sheet P1 and the leading end of the continuous sheet P2 are bonded to each other by a splicing tape, so that the continuous sheet P1 and the continuous sheet P2 are connected to each other. The connection work is performed by, for example, the user.

After the continuous sheet P1 and the continuous sheet P2 are connected to each other, the printing is resumed. Since the box sheet is used, the blank paper printing is performed on two pages, and then printing according to the print job is performed on the continuous sheet P2. Even during the printing, unless the transport prohibition is released, the transport control unit 54 prohibits the continuous sheet P from being transported in response to the user's operation.

Hereinafter, operation of the printing apparatus 10 after the trailing end PE of the continuous sheet P1 is detected will be described in detail with reference to FIGS. 7 to 10. FIGS. 7 to 10 schematically illustrate the continuous sheet. In the following description, when the option indicating "execute the splicing process" is set by the user or when the option indicating "automatically determine whether to execute the splicing process" is set by the user, it is assumed that a print job is in progress at the time when the trailing end PE of a continuous sheet P1 is detected.

In FIGS. 7 to 10, a position indicated by an arrow 76 is a position at which the trailing end PE of the continuous sheet P is detected by the detection sensor 34, and a position indicated by an arrow 78 is a transfer position between the photoconductor drum 14 and the transfer device 22. In addition, folds such as perforations formed in the continuous sheet P1 and the continuous sheet P2 are represented by broken lines. A region between one fold and the next fold is one page.

Figure 7:
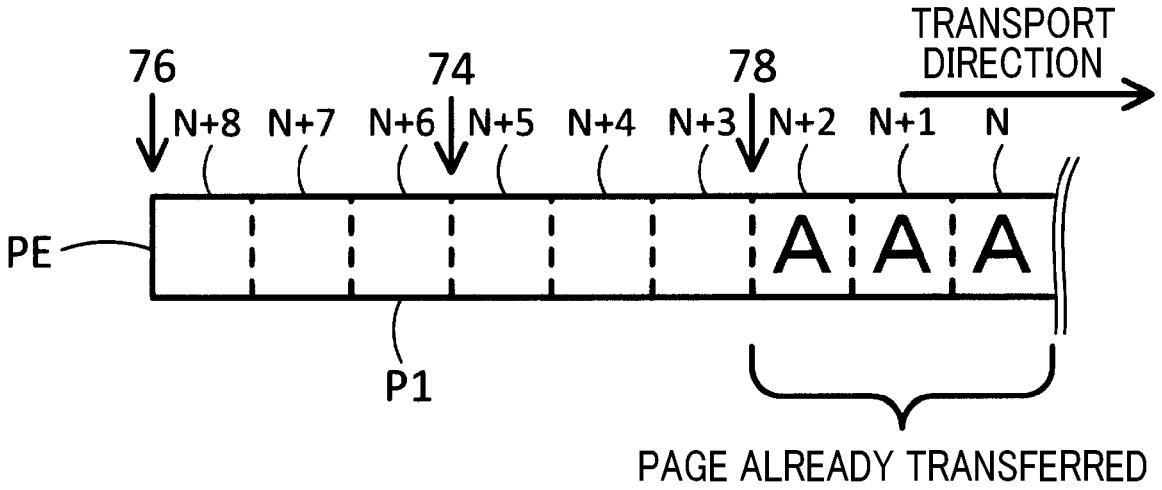
FIG. 7 is a diagram schematically illustrating the continuous sheet.

FIG. 7 illustrates an N-th page to an (N+8)-th page of the continuous sheet P1. The (N+8)-th page is the final page of the continuous sheet P1, and the trailing end PE of the (N+8)-th page is the trailing end PE of the continuous sheet P1. In addition, the transfer device 22 has already performed transfer on the N-th page to an (N+2)-th page.

Figure 8:
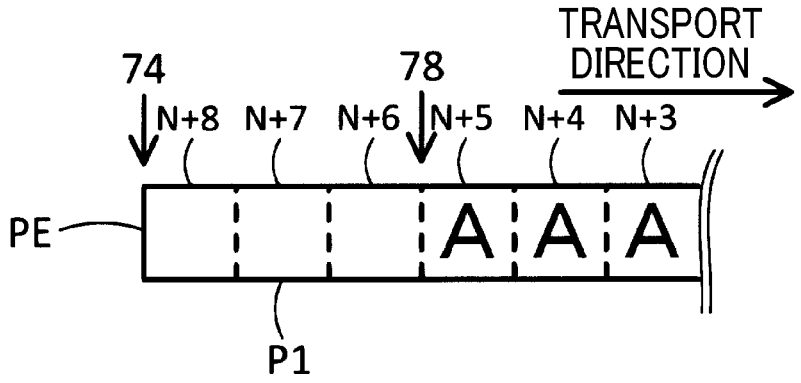
FIG. 8 is a diagram schematically illustrating the continuous sheet.

When the detection sensor 34 detects the trailing end PE of the continuous sheet P1, that is, when the detection sensor 34 detects the trailing end PE of the (N+8)-th page which is the final page, as illustrated in FIG. 8, the transport control unit 54 causes the transport unit 42 to transport the continuous sheet P1 until the trailing end PE of the (N+8)-th page is placed at the splice position 74. Meanwhile, the printing unit 40 continues printing. In the example illustrated in FIG. 8, after the trailing end PE is detected, transfer is performed on an (N+3)-th page to an (N+5)-th page. Further, after the trailing end PE is detected, the transport control unit 54 prohibits the continuous sheet P1 from being transported in response to the user's operation.

Figure 9:
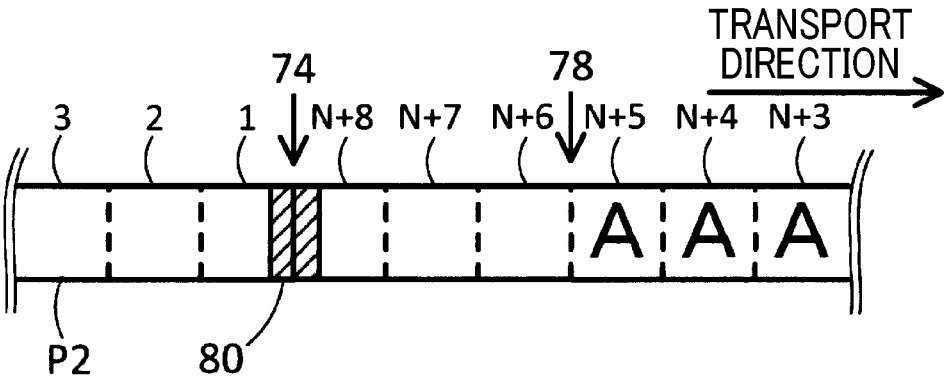
FIG. 9 is a diagram schematically illustrating the continuous sheet.

Next, the user places another new continuous sheet P2 which is a box sheet in the sheet hopper 30, and as illustrated in FIG. 9, at the splice position 74, the user bonds the trailing end PE of the (N+8)-th page of the continuous sheet P1 and the leading end of the first page of the continuous sheet P2 to each other by a splicing tape 80, so that the continuous sheet P1 and the continuous sheet P2 are connected to each other.

Since the continuous sheet P1 and the continuous sheet P2 are the box sheets, the number of splice pages is two. Specifically, since the splicing tape 80 is attached to the (N+8)-th page of the continuous sheet P1 and the first page of the continuous sheet P2, these pages are the splice pages, and the blank paper printing is performed on these pages. That is, when the box sheet is used, performing the blank paper printing on the two pages to which the splicing tape 80 is attached prevents printing according to the print job from being performed on the splice pages. The transport and printing for the connected continuous sheets P1 and P2 are controlled so that the blank paper printing is performed on the splice pages and printing according to the print job is performed on pages other than the splice pages.

Specifically, the main control unit 56 specifies the splice pages based on (i) the distance between the splice position 74 and the transfer position 78 and (ii) a width of one page in the transport direction. In the example illustrated in FIGS. 7 to 10, since the distance between the splice position 74 and the transfer position 78 corresponds to a length of three pages, the main control unit 56 recognizes that the third and fourth pages counted from the transfer position 78 are splice pages. The third page is the (N+8)-th page of the continuous sheet P1, and the fourth page is the first page of the continuous sheet P2.

Figure 10:
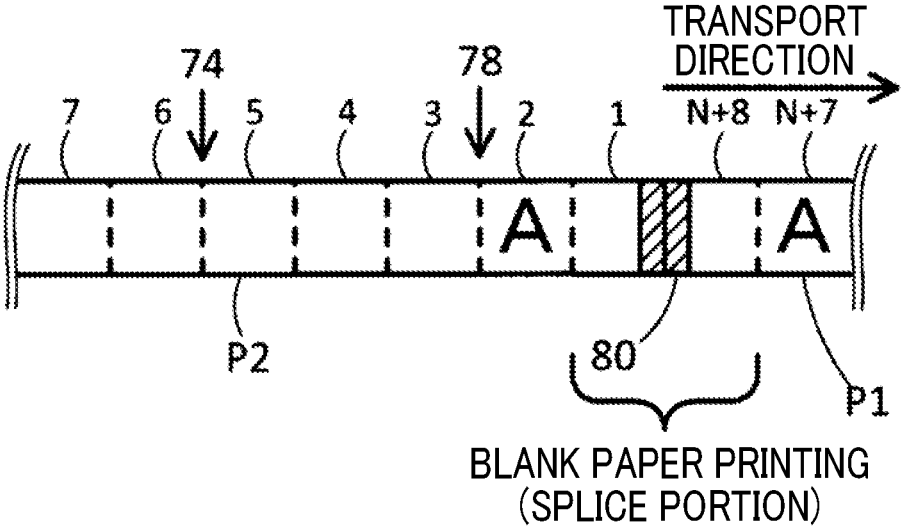
FIG. 10 is a diagram schematically illustrating the continuous sheet.

As illustrated in FIG. 10, the printing unit 40 performs printing according to the print job on the (N+6)-th page of the continuous sheet P1 which is the first page counted from the transfer position 78 and the (N+7)-th page of the continuous sheet P1 which is the second page, and performs the blank paper printing on the (N+8)-th page of the continuous sheet P1 which is the third page and the first page of the continuous sheet P2 which is the fourth page. The printing unit 40 performs the printing according to the print job on the second and subsequent pages of the continuous sheet P2.

When the splicing process is to be executed, it is prohibited the continuous sheets P1 and P2 from being transported in response to the user's operation. Therefore, the printing according to the print job is prevented from being performed on the (N+8)-th page of the continuous sheet P1 and the first page of the continuous sheet P2 which are the splice pages, due to the transport operation of the user.

Figure 11:
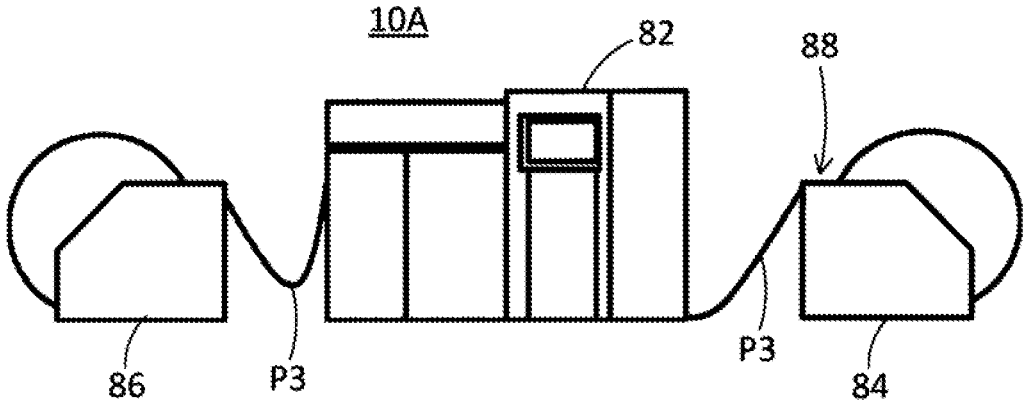
FIG. 11 is a diagram illustrating another configuration of the printing apparatus according to the exemplary embodiment.
Figure 12:
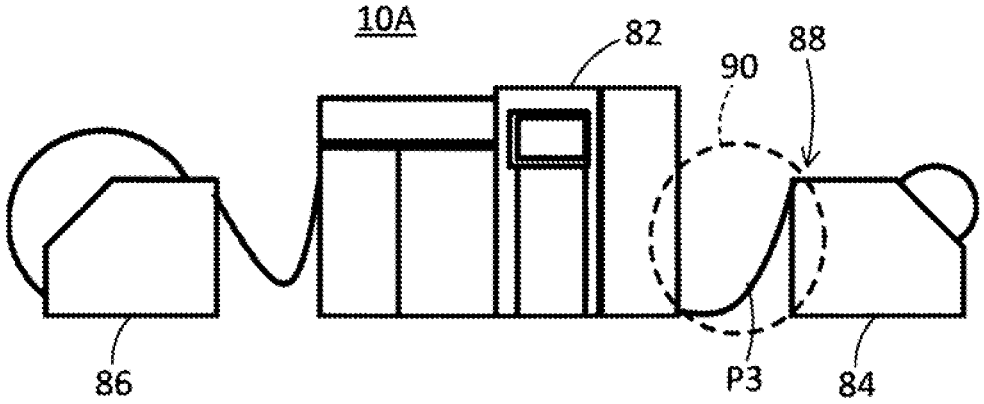
FIG. 12 is a diagram illustrating the another configuration of the printing apparatus according to the exemplary embodiment.

Hereinafter, when a roll sheet is used as a continuous sheet will be described with reference to FIGS. 11 and 12. FIGS. 11 and 12 illustrate a configuration of a printing apparatus 10A in which the roll sheet is used. The printing apparatus 10A includes a printing apparatus main body 82 that performs printing on a roll sheet P3, a sheet feeding unit 84 that accommodates the roll sheet P3 and supplies the roll sheet P3 to the printing apparatus main body 82, and an accommodating unit 86 that accommodates the roll sheet P3 for which printing is completed. A configuration of the printing apparatus main body 82 is the same as the configuration of the printing apparatus 10 except for the sheet hopper 30, the sheet stacker 32, and the detection sensors 34 and 36. A detection sensor that detects the trailing end of the roll sheet P3 is provided, for example, in the sheet feeding unit 84. A splice position 88 is determined in the sheet feeding unit 84. In the same manner as the printing apparatus 10, the printing apparatus 10A is controlled by the control device 12.

When the roll sheet P3 is used, transport control is performed according to whether to execute the splicing process, as in the case where the box sheet is used.

When the roll sheet P3 is used, the roll sheet P3 may be loosely bent between an installation position of the printing apparatus main body 82 and the splice position 88 as indicated by a dashed circle 90 illustrated in FIG. 12. Therefore, the number of splice pages is determined based on (i) the distance between the installation position of the printing apparatus main body 82 and the splice position 88 and (ii) the amount of loose bending of the roll sheet P3 between the installation position of the printing apparatus main body 82 and the splice position 88. For example, the user inputs information indicating the distance and the amount of loose bending using the UI unit 44 or the UI unit 60. The main control unit 56 calculates the length of the roll sheet P3 between the installation position of the printing apparatus main body 82 and the splice position 88 based on the distance and the amount of loose bending and calculates the number of splice pages and positions of the splice pages on the roll sheet P3 based on the length. The blank paper printing is performed on the splice pages determined in this manner, and the printing according to the print job is performed on the other pages.

MODIFICATION EXAMPLE 1

Figure 13:
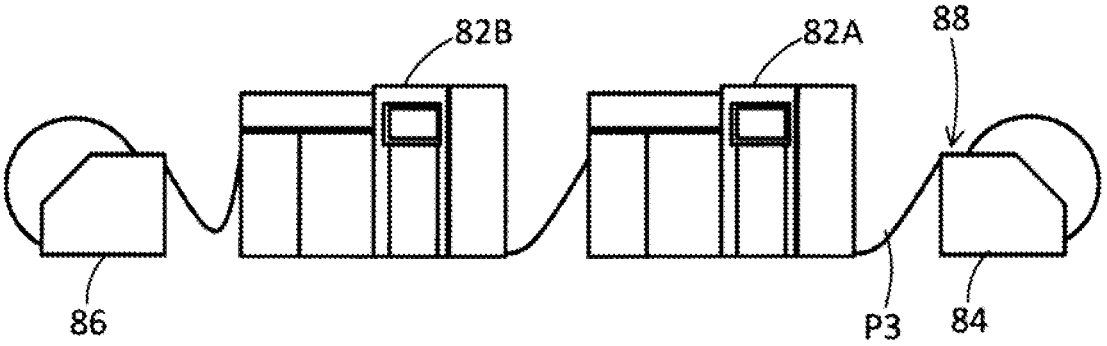
FIG. 13 is a diagram illustrating a configuration of a printing system according to Modification Example 1.

Hereinafter, Modification Example 1 will be described with reference to FIG. 13. FIG. 13 is a diagram illustrating an example of a configuration of a printing system according to Modification Example 1.

The printing system according to Modification Example 1 includes plural printing apparatus main bodies. In the example illustrated in FIG. 13, the printing system includes printing apparatus main bodies 82A and 82B. The printing system may include three or more printing apparatus main bodies. The printing apparatus main bodies 82A and 82B have the same configuration as the printing apparatus main body 82 illustrated in FIGS. 11 and 12. Further, as an example, the roll sheet P3 is used. The printing system further includes the sheet feeding unit 84 which accommodates the roll sheet P3 and supplies the roll sheet P3 to the printing apparatus main body 82A, the accommodating unit 86 which accommodates the roll sheet P3 for which printing is completed and which is discharged from the printing apparatus main body 82B, and the control device 12 which controls the printing apparatus main bodies 82A and 82B. In addition, the roll sheet P3 discharged from the printing apparatus main body 82A is supplied to the printing apparatus main body 82B.

In Modification Example 1, multiple printing is performed using the printing apparatus main bodies 82A and 82B. The multiple printing is printing using plural printing apparatuses. For example, respective printing apparatuses perform printing on different sides, respective printing apparatuses perform printing with different colors, respective printing apparatuses perform printing according to different types of data (for example, image data, document data, or the like), respective printing apparatuses partially perform printing, or the like. As an example of the multiple printing, printing is performed on one side by a printing apparatus located upstream in a transport direction of the continuous sheet, and printing is performed on the other side by a printing apparatus located downstream in the transport direction. In the example illustrated in FIG. 13, the printing apparatus main body 82A is provided upstream in a transport direction, and the printing apparatus main body 82B is provided downstream. Printing is performed on one side of the roll sheet P3 by the printing apparatus main body 82A, and printing is performed on the other side of the roll sheet P3 by the printing apparatus main body 82B.

In Modification Example 1, in the same manner as in the exemplary embodiment described above, the transport control is performed according to whether to execute the splicing process. In Modification Example 1, when it is prohibited in the printing apparatus main body 82A that the roll sheet P3 is transported in response to the user's operation, it is also prohibited in the printing apparatus main body 82B that the roll sheet P3 is transported in response to the user's operation. For example, information indicating that it is prohibited that the roll sheet P3 is transported in response to the user's operation is shared by the printing apparatus main bodies 82A and 82B. Specifically, when it is prohibited in the printing apparatus main body 82A that the roll sheet P3 is transported in response to the user's operation, information indicating the prohibition is transmitted from the printing apparatus main body 82A or the control device 12 to the printing apparatus main body 82B.

In addition, on splice pages on which the blank paper printing is performed, the printing apparatus main body 82A prints blank paper printing page information indicating that the splice pages are pages on which the blank paper printing is performed, as a mark. The printing apparatus main body 82B specifies the splice pages by detecting the mark, and performs the blank paper printing on the splice pages. The printing apparatus main body 82A may print a mark and further transmit page ID for identifying the splice pages to the printing apparatus main body 82B. The printing apparatus main body 82B specifies the splice pages based on the mark and the page ID, and performs the blank paper printing on the splice pages.

MODIFICATION EXAMPLE 2

Hereinafter, Modification Example 2 will be described. In the following, when the option indicating "execute the splicing process" is set by the user or when the option indicating "automatically determine whether to execute the splicing process" is set by the user, it is assumed that the print job is in progress at the time when the trailing end PE of the continuous sheet P1 is detected. In Modification Example 2, in addition to the above condition, when box sheet is used as the continuous sheet P, the transport control unit 54 prohibits that the continuous sheet P is transported in response to the user's operation at the time when the trailing end of the continuous sheet P is detected. On the other hand, even under the above condition, when a roll sheet is used as the continuous sheet P, the transport control unit 54 does not prohibit that the continuous sheet P is transported in response to the user's operation at the time when the trailing end of the continuous sheet P is detected.

Each of pages constituting the box sheet is distinguished by folds such as perforations. Therefore, when the box sheet is transported in response to the user's operation in execution of the splicing process, the printing according to the print job may be performed across a fold depending on a position of the transported box sheet. When the continuous sheet P is the box sheet, by prohibiting the continuous sheet P from being transported in response to the user's operation, it is possible to prevent the printing according to the print job from being performed across the fold.

On the other hand, since no fold is formed on the roll sheet, there does not arise such a problem that printing is performed across the fold, which can occur for a box sheet.

In this way, it can be said that the box sheet is a sheet which is desired to less move in execution of the splicing processes than the roll sheet. Therefore, by preventing the continuous sheet P from being transported in response to the user's operation when the box sheet is used, it can be prevented that the continuous sheet P is transported in response to the user's operation when the continuous sheet P which is desired to less move is used.

MODIFICATION EXAMPLE 3

Hereinafter, Modification Example 3 will be described. In Modification Example 3, according to the user, the transport control unit 54 prohibits or permits that the continuous sheet P is transported in response to the user's operation at the time when the trailing end of the continuous sheet P is detected.

For example, for each user, user identification information for identifying him/her and information indicating whether to prohibit transport at the time when the trailing end of the continuous sheet P is detected are stored in the storage unit 46 in advance in association with each other. The user identification information includes, for example, information indicating a name of a user, a user ID, or the like. The user identification information may further include information indicating a proficiency degree of the user regarding work or an operation related to the printing apparatus 10, information indicating a job position of the user, information indicating a work history of the user, and the like. For example, a user may operate the UI unit 44 or the UI unit 60 to input user identification information into the printing apparatus 10, or input user identification information into the printing apparatus 10 using an IC card such as an employee ID card. The transport control unit 54 identifies a user who uses the printing apparatus 10 based on the input user identification information. Also, a shift table may be used that defines a time slot in which each user uses the printing apparatus 10. In this case, the transport control unit 54 obtains data of the shift table from a management device that manages the shift table, and identifies a user who uses the printing apparatus 10 at the present time based on the shift table.

When the above association shows that information indicating transport prohibition is associated with the identified user, the transport control unit 54 prohibits that the continuous sheet P is transported in response to the user's operation at the time when the trailing end of the continuous sheet P is detected. When the information indicating the transport prohibition is not associated with the identified user, the transport control unit 54 permits that the continuous sheet P is transported in response to the user's operation at the time when the trailing end of the continuous sheet P is detected. In this manner, the transport control is performed according to each user.

For example, it is assumed that the user who uses the printing apparatus 10 is a skilled person. In this case, even if it is permitted to transport the continuous sheet P in response to the user's operation at the time when the trailing end of the continuous sheet P is detected, it is expected that printing according to the print job is unlikely to be performed on the splice pages due to transport in response to the user's operation. Further, the skilled person may want to finely adjust the splice position or the like in the splicing process. Therefore, when the user is the skilled person, regardless of whether the splicing process is actually executed, the transport control unit 54 permits that the continuous sheet P is transported in response to the user's operation at the time when the trailing end of the continuous sheet P is detected.

On the other hand, when the user who uses the printing apparatus 10 is not a skilled person and when it is permitted to transport the continuous sheet P in response to the user's operation at the time when the trailing end of the continuous sheet P is detected, it is expected that the printing according to the print job is likely to be performed on the splice pages due to transport in response to the user's operation. In order to address this matter, when the user is not a skilled person, regardless of whether the splicing process is actually executed, the transport control unit 54 prohibits that the continuous sheet P is transported in response to the user's operation at the time when the trailing end of the continuous sheet P is detected.

For example, a user who has a proficiency degree equal to or higher than a threshold value is a skilled person, and a user who has the proficiency degree less than the threshold value is not a skilled person. Information indicating the proficiency degree is included in the user identification information. When the proficiency degree of the user who uses the printing apparatus 10 is equal to or higher than the threshold value, the transport control unit 54 permits that the continuous sheet P is transported in response to the user's operation at the time when the trailing end of the continuous sheet P is detected. When the proficiency degree of the user who uses the printing apparatus 10 is less than the threshold value, the transport control unit 54 prohibits that the continuous sheet P is transported in response to the user's operation at the time when the trailing end of the continuous sheet P is detected. In this manner, the transport control is performed according to the proficiency degree of each user.

Further, when it is prohibited that the continuous sheet P is transported in response to the operation of the user, the transport control unit 54 may permit or prohibit release of the prohibition in accordance with the user. For example, when a skilled person instructs to release the transport prohibition, the transport control unit 54 releases the transport prohibition. When a user who is not a skilled person instructs to release the transport prohibition, the transport control unit 54 continues the transport prohibition without releasing the transport prohibition. In this manner, the transport prohibition is prevented from being released by the user who is not a skilled person.

The main control unit 56 may learn the user's operation for transporting the continuous sheet P. Based on this learning result, the transport control unit 54 may prohibit or permit that the continuous sheet P is transported in response to the user's operation at the time when the trailing end of the continuous sheet P is detected. For example, according to a frequency of performing the splicing process, the transport control unit 54 may prohibit or permit that the continuous sheet P is transported in response to the user's operation at the time when the trailing end of the continuous sheet P is detected. Further, based on an execution history of the splicing process by each user, the transport control unit 54 may prohibit or permit to transport the continuous sheet P in response to the operation of each user at the time when the trailing end of the continuous sheet P is detected.

When the user who uses the printing apparatus 10 changes with another user, the main control unit 56 may cause the UI unit 44 or the UI unit 60 to display a screen for inquiring the user whether to execute the splicing process. The main control unit 56 recognizes the changed user based on the user identification information input to the printing apparatus 10, for example.

For example, a user who is not a skilled person may set the option indicating "execute the splicing process" at the start of printing, and the user may change with a skilled person during the printing, at the time when the trailing end of continuous sheet P is detected, or the like. Even when the trailing end of the continuous sheet P is detected, the skilled person may want to transport the continuous sheet P in response to his/her operation. In order to address this, the skilled person changes the option indicating "execute the splicing process" to the option indicating "do not execute the splicing process" on the inquiry screen, thereby it is possible to transport the continuous sheet P in response to the operation of the skilled person.

Further, a skilled person uses the printing apparatus 10 at the start of printing, and the skilled person may change with a user who is not a skilled person during the printing, at the time when the trailing end of the continuous sheet P is detected, or the like. There is a possibility that the option indicating "do not execute the splicing process" is set by the skilled person. Therefore, if the settings are as they are, the continuous sheet P may be transported in response to the operation of the user who is not a skilled person, and the printing according to the print job may be performed on the splice pages. In order to avoid this, the user who is not a skilled person sets the option indicating "execute the splicing process" on the inquiry screen, so that it is prohibited that the continuous sheet P is transported in response to the user's operation, and the printing according to the print job is prevented from being performed on the splice pages.

The function of each of the units of the printing apparatus 10 and the control device 12 described above is implemented by cooperation of hardware and software, as an example. Specifically, the printing apparatus 10 and the control device 12 include one or plural processors such as a CPU (not illustrated) or the like. The function of each of the units of the printing apparatus 10 and the control device 12 is implemented by the one or plural processors reading and executing a program stored in a storage device (not illustrated). The program is stored in the storage device via a recording medium such as a CD, a DVD, or the like or via a communication path such as a network or the like. As another example, the function of each of the units of the printing apparatus 10 and the control device 12 may be implemented by a hardware resource such as a processor, an electronic circuit, an application specific integrated circuit (ASIC), or the like. A device such as a memory or the like may be used in implementation. As still another example, the function of each of the units of the printing apparatus 10 and the control device 12 may be implemented by a digital signal processor (DSP), a field programmable gate array (FPGA), or the like.

The foregoing description of the exemplary embodiments of the present disclosure has been provided for the purposes of illustration and description. It is not intended to be exhaustive or to limit the present disclosure to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An information processing apparatus comprising:

a controller configured to:

determine whether a splicing process of splicing a continuous sheet and another continuous sheet to each other is to be executed when a trailing end of the continuous sheet transported by a printing unit is detected; and in a case that the splicing process is to be executed, prohibit the continuous sheet from being transported in response to a user's operation at a time when the trailing end of the continuous sheet is detected.

2. The information processing apparatus according to claim 1, wherein when an instruction to execute the splicing process is given by the user in advance before the trailing end is detected, the controller determines that the splicing process is to be executed.

3. The information processing apparatus according to claim 2, wherein when the transport of the continuous sheet is prohibited, the controller releases the prohibition of the transport of the continuous sheet, in response to a user's operation.

4. The information processing apparatus according to claim 1, wherein when the trailing end is detected, the controller further inquires with the user whether to execute the splicing process, and when the user gives an instruction to execute the splicing process, the controller determines that the splicing process is to be executed.

5. The information processing apparatus according to claim 4, wherein the controller further prohibits the continuous sheet from being transported until the user gives an instruction as to whether to execute the splicing process.

6. The information processing apparatus according to claim 5, wherein the controller further releases the prohibition of the transport of the continuous sheet when the user instructs not to execute the splicing process.

7. The information processing apparatus according to claim 6, wherein when the transport of the continuous sheet is prohibited, the controller releases the prohibition of the transport of the continuous sheet, in response to a user's operation.

8. The information processing apparatus according to claim 5, wherein when the transport of the continuous sheet is prohibited, the controller releases the prohibition of the transport of the continuous sheet, in response to a user's operation.

9. The information processing apparatus according to claim 4, wherein when the transport of the continuous sheet is prohibited, the controller releases the prohibition of the transport of the continuous sheet, in response to a user's operation.

10. The information processing apparatus according to claim 1, wherein if printing remains at the time when the trailing end is detected, the controller determines that the splicing process is to be executed.

11. The information processing apparatus according to claim 10, wherein when the transport of the continuous sheet is prohibited, the controller releases the prohibition of the transport of the continuous sheet, in response to a user's operation.

12. The information processing apparatus according to claim 1, wherein when it is determined that the splicing process is to be executed and when a continuous sheet in a state of being folded is used as the continuous sheet, the controller prohibits the continuous sheet from being transported in response to the user's operation at the time when the trailing end is detected.

13. The information processing apparatus according to claim 12, wherein when the transport of the continuous sheet is prohibited, the controller releases the prohibition of the transport of the continuous sheet, in response to a user's operation.

14. The information processing apparatus according to claim 1, wherein when the transport of the continuous sheet is prohibited, the controller releases the prohibition of the transport of the continuous sheet, in response to the user's operation.

15. An information processing apparatus comprising:

a controller configured to prohibit a continuous sheet from being transported in response to a user's operation during a period in which a printing unit performs printing on the continuous sheet, and release the prohibition when a trailing end of the continuous sheet is detected, wherein if it is determined that a process of connecting the continuous sheet and another continuous sheet to each other is to be when the trailing end of the continuous sheet is detected, the controller continues the prohibition.

16. A non-transitory computer readable medium storing a program that causes a computer to execute information processing, the information processing comprising:

determining whether a splicing process of splicing a continuous sheet and another continuous sheet to each other is to be executed when a trailing end of the continuous sheet transported by a printing unit is detected; and in a case that the splicing process is to be executed, prohibiting the continuous sheet from being transported in response to a user's operation at a time when the trailing end of the continuous sheet is detected.

* * * * *